US005502879A

United States Patent [19]

Rinder

[11] Patent Number: 5,502,879

[45] Date of Patent: Apr. 2, 1996

[54] PIVOTED APPARATUS HAVING A SLIDER CRANK MECHANISM FOR NEEDLING A NONWOVEN WEB

[75] Inventor: Laurenz Rinder, Vienna, Austria

[73] Assignee: Textilmaschinenefabrik Dr. Ernst Fehrer Aktiengesellschaft, Leonding, Austria

[21] Appl. No.: 488,485

[22] Filed: Jun. 8, 1995

[30] Foreign Application Priority Data

Jun. 27, 1994 [AT] Austria ..... 1260/94

[51] Int. Cl.[6] ..... D04H 18/00

[52] U.S. Cl. ..... 28/115; 28/107

[58] Field of Search ..... 28/107, 108, 109, 28/110, 111, 113, 114, 115; 112/284, 220, 80.4, 80.41, 80.42, 80.45

[56] References Cited

U.S. PATENT DOCUMENTS 3,116,534 1/1964 O'Byrne ..... 28/107

FOREIGN PATENT DOCUMENTS 249392 9/1966 Austria ..... 28/107

263395 7/1968 Austria ..... 28/107

1435772 11/1968 Germany ..... 28/107

2000617 7/1971 Germany ..... 28/107

*Primary Examiner*—C. D. Crowder

*Assistant Examiner*—Larry D. Worrell, Jr.

*Attorney, Agent, or Firm*—Collard & Roe

[57] ABSTRACT

The described apparatus for needling a nonwoven web comprises at least one needle beam carrying a needle board, a rocker for guiding the needle beam, and a slider-crank mechanism for actuating the needle beam. For a first-order mass balancing it is proposed that the slider-crank mechanism comprises two parallel crankshafts or eccentric shafts, which are adapted to be driven to rotate in mutually opposite senses, and associated connecting rods, which are connected by connecting rods to a link, which is pivoted to the rocker, and the arrangement is such that when the slider-crank mechanism is in a mid-position at the middle of its strike the plane of symmetry between the two crankshafts or eccentric shafts is at least approximately at right angles to a plane which contains the instantaneous overall center of gravity of the oscillating masses and the pivotal axis of the rocker.

3 Claims, 1 Drawing Sheet

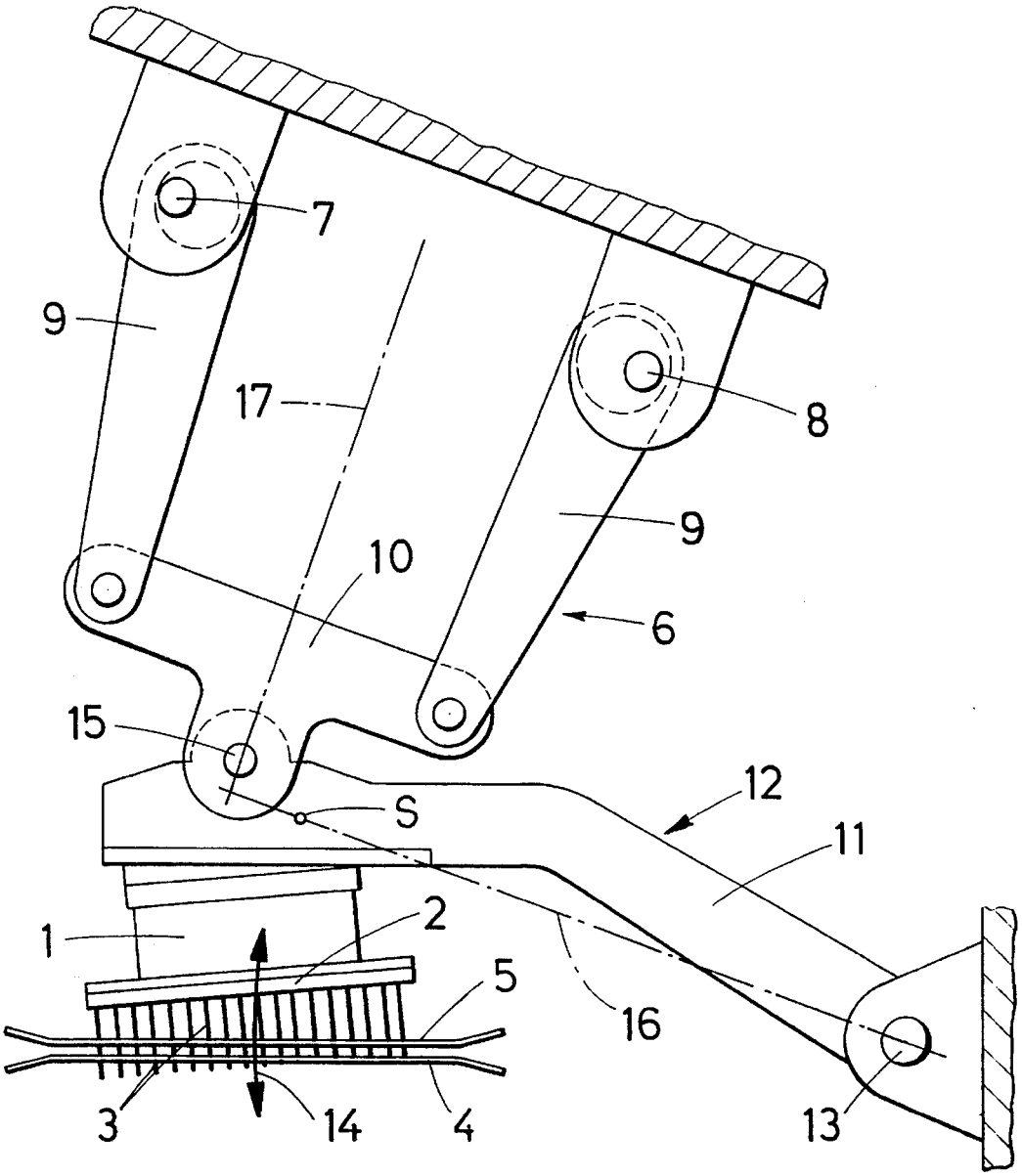
7
9
17
8
9
10
6
15
12
S
11
1
2
5
16
3
14
4
13

PIVOTED APPARATUS HAVING A SLIDER CRANK MECHANISM FOR NEEDLING A NONWOVEN WEB

BACKGROUND OF THE INVENTION

1. Field of the Invention

This invention relates to an apparatus for needling a nonwoven web, which apparatus comprises at least one needle beam carrying a needle board, a rocker for guiding the needle beam, and a slider-crank mechanism for actuating the needle beam.

2. Description of the Prior Art

Needle beams which carry needle boards are actuated in general by slider-crank mechanisms, which are either connected to the needle beams by means of push rods in sliding contact with guides or which are pivoted to rockers, which carry the needle beams (Austrian Patent Specification 249, 392). The guiding of the needle beam by means of a rocker affords the advantage that the structure is simple because gush rods and associated guides are no longer required between the connecting rods of the slider-crank mechanisms and the rockers. But a simple guidance by a rocker will cause the needles to move along an arc of a circle and although the lever length of the rocker is large relative to the amplitude of oscillation this may influence the needling effect so that the non-woven web is more effectively felted than when the needles are guided along a straight path. It must be taken into account, however, that the depth of penetration will vary in dependence on the distance from the pivotal axis of the rocker in the direction of travel of the nonwoven web.

Regardless of whether the needles are guided along a straight path or by a rocker, the use of slider-crank mechanisms for reciprocating the needle board will give rise to vibration problems. If slider-crank mechanisms are used to actuate needle beams which are guided along a straight line by means of push rods, it is known to balance the first-order mass forces and mass moments in that the slider-crank mechanism is provided with two parallel crankshafts or eccentric shafts, which can be driven to rotate in mutually opposite senses and are connected by connecting rods to a common link, which is connected to the push rods. But such means for mass balancing cannot readily be used with a rocker for guiding needle boards because the movement of the needle board along an arc of a circle will give rise to considerable transverse vibrations if the slider-crank mechanism is conventionally arranged.

SUMMARY OF THE INVENTION

For this reason it is an object of the invention to provide for needling a nonwoven web an apparatus which is of the kind described first hereinbefore and comprises structurally simple means for effecting a substantial balancing of the first-order mass forces and mass moments.

The object set forth is accomplished in accordance with the invention in that the slider-crank mechanism comprises two parallel crankshafts or eccentric shafts, which are adapted to be driven to rotate in mutually opposite senses, and associated connecting rods to a link, which is pivoted to the rocker, and the arrangement is such that when the slider-crank mechanism is in a mid-position at the middle of its stroke the plane of symmetry between the two crankshafts or eccentric shafts is at least approximately at right angles to a plane which contains the instantaneous overall center of gravity of the oscillating masses and the pivotal axis of the rocker.

The provision of two crankshafts or eccentric shafts which rotate in mutually opposite senses cannot result in a substantially complete balancing of the first-order mass forces and mass moments unless the main direction of the action of the slider-crank mechanism coincides with the main direction of the motion of the overall center of gravity of the oscillating masses because only in that case will it be possible to attach corresponding counterbalancing masses. For this reason the slider-crank mechanism is so arranged in accordance with the invention that when the slider-crank mechanism is in a mid-position at the middle of its stroke the plane of symmetry between the two crankshafts or eccentric shafts is at right angles to that plane which contains the instantaneous overall center of gravity of the oscillating masses and the pivotal axis of the rocker and for this reason said plane of symmetry is at right angles to the main direction of the motion of the overall center of gravity. In that connection it must be taken into account that the pivotal axis on which the rocker is connected to the link by which the connecting rods are interconnected moves along an arc of a circle so that a transverse displacement is relative to the plane of symmetry between the two crankshafts or eccentric shafts is imparted to the link and, as a result, a further influence is exerted on the path of motion of the overall center of gravity. Because adjacent to the overall center of gravity of the oscillating masses of the slider-crank mechanism, the rocker, the needle beam and the needle board the main direction of the motion of the slider-crank mechanism is tangentially aligned with the arc of a circle along which the rocker is moved, an effective first-order mass balancing can be achieved without a substantial increase of the structural expenditure over that involved in the use of straight-line guides.

BRIEF DESCRIPTION OF THE DRAWING

The subject matter of the invention is illustrated by way of example in the drawing, FIG. 1 is a schematic side elevation showing an apparatus for needling a non-woven web in accordance with the invention

DETAILED DESCRIPTION OF THE PREFERRED EMBODIMENT

The illustrated apparatus comprises as usual at least one needle board 2, which is held in a needle beam 1 and provided with needles 3, which pierce a nonwoven web that is guided between a web support 4 and a stripper 5. The needles can move through the web support 4 and the stripper 5 because the parts 4 and 5 consist of perforated plates. The needle board 2 is actuated by means of a slider-crank mechanism 6, which comprises two parallel crankshafts or eccentric shafts 7, 8, which are driven to rotate in mutually opposite senses, and connecting rods 9, which are movably mounted on said crankshafts or eccentric shafts 7, 8 and are interconnected by a link 10 in a four-bar linkage. A rocker 12 consisting of parallel arms 11 is pivoted to the link 12 in the middle of its length. The pivotal axis of that rocker 12 is designated 13. Because the needle beam 1 is guided by the rocker 12, the needle board 2 is moved up and down by the slider-crank mechanism 6 along an arc of a circle 14 about the pivotal axis 13. The movement of the rocker about the pivotal axis 13 is compensated by a wobbling motion of the link about the pivotal axis 13 on which the link is connected to the rocker 12.

The overall center of gravity 5 of the oscillating masses consisting of the slider-crank mechanism 6, the rocker 12, and the parts 1, 2, and 3 carried by the rocker oscillates along a path which deviates from an arc of a circle about the pivotal axis 13. But when the slider-crank mechanism 6 is in the illustrated mid position at the middle of its stroke said path is at right angles to the plane 16, which is defined by the instantaneous overall center of gravity S and the pivotal axis 13. For this reason the main direction of the motion of the slider-crank mechanism 6 and the main direction of the motion of the overall center of gravity S will substantially agree if the slider-crank mechanism 6 is so arranged that when it is in a mid-position at the middle of its stroke the plane of symmetry 17 between the two crankshafts or eccentric shafts 7, 8 is at right angles to the plane 16 which contains the instantaneous center of gravity of the oscillating masses and the pivotal axis 13 of the rocker 12. Desirable conditions for a first-order mass balance will thus be provided because it will be sufficient to attach corresponding counterbalancing masses to the crankshafts or eccentric shafts 7 and 8.

I claim:

1. In an apparatus for needling a nonwoven web, which apparatus comprises a reciprocable needle beam, a needle board carried by said needle beam, a slider-crank mechanism for reciprocating said needle beam, and a pivoted rocker for guiding said needle beam as it is reciprocated by said slider-crank mechanism, wherein said needle beam, said needle board, said slider-crank mechanism, and said rocker constitute oscillating masses having an overall center of gravity, the improvement residing in that said slider-crank mechanism comprises two parallel crankshafts, which are operable to rotate in mutually opposite senses to move said slider-crank mechanism through a predetermined mid-position at the middle of its stroke, and connecting rods rotatably mounted on said crankshafts and interconnected by a link, which is pivoted to said rocker on a pivotal axis, said two crankshafts define between them a plane of symmetry, and the arrangement is such that when said slider-crank mechanism is in its said mid-position said plane is substantially at right angles to a plane which contains the instantaneous overall center of gravity of said oscillating masses and said pivotal axis of said rocker.

2. The improvement set forth in claim 1, wherein said crankshafts are eccentric shafts.

3. The improvement set forth in claim 1, wherein said pivotal axis is disposed in the middle of the length of said link.

* * * * *